US007999695B2

(12) United States Patent
Rodney et al.

(10) Patent No.: US 7,999,695 B2
(45) Date of Patent: Aug. 16, 2011

(54) SURFACE REAL-TIME PROCESSING OF DOWNHOLE DATA

(75) Inventors: Paul F. Rodney, Spring, TX (US); Daniel D. Gleitman, Houston, TX (US); James H. Dudley, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 939 days.

(21) Appl. No.: 10/792,541

(22) Filed: Mar. 3, 2004

(65) Prior Publication Data

US 2005/0194182 A1 Sep. 8, 2005

(51) Int. Cl.
*G01V 1/00* (2006.01)

(52) U.S. Cl. ..... 340/855.5; 340/853.3; 73/152.01; 73/152.03; 702/11; 702/12

(58) Field of Classification Search ..... 340/853.3, 340/855.5; 73/152.01, 152.03; 702/11, 12
See application file for complete search history.

(56) References Cited

U.S. PATENT DOCUMENTS

| | | | | |
|---|---|---|---|---|
| 3,223,184 | A | 12/1965 | Jones et al. | 175/41 |
| 4,273,212 | A | 6/1981 | Dorr et al. | 181/102 |
| 4,379,493 | A | 4/1983 | Thibodeaux | 175/61 |
| 4,384,483 | A | 5/1983 | Dellinger et al. | 73/151 |
| 4,535,429 | A | 8/1985 | Russell et al. | 367/85 |
| 4,553,428 | A | 11/1985 | Upchurch | 73/152 |
| 4,697,650 | A | 10/1987 | Fontenot | 175/50 |
| 4,779,852 | A | 10/1988 | Wassell | 267/125 |
| 4,791,797 | A | 12/1988 | Paske et al. | 73/152 |
| 4,805,449 | A | 2/1989 | Das | 73/151 |
| 4,995,058 | A * | 2/1991 | Byers et al. | 340/855.5 |
| 5,156,223 | A | 10/1992 | Hipp | 175/296 |
| 5,331,318 | A * | 7/1994 | Montgomery | 340/855.4 |
| 5,563,512 | A | 10/1996 | Mumby | 324/339 |
| 5,679,894 | A | 10/1997 | Kruger et al. | 73/152.03 |
| 5,691,712 | A * | 11/1997 | Meek et al. | 340/853.3 |
| 5,798,488 | A | 8/1998 | Beresford et al. | 181/102 |
| 5,804,713 | A | 9/1998 | Kluth | 73/152.01 |
| 5,886,303 | A | 3/1999 | Rodney | 181/102 |

(Continued)

FOREIGN PATENT DOCUMENTS

GB 2235540 A 3/1991

OTHER PUBLICATIONS

E Alan Coats, Marty Paulk, Chris Dalton, "Wired Composite Tubing Reduces Drilling Risk," Drilling Contractor, pp. 22-23, Jul./Aug. 2002.

(Continued)

*Primary Examiner* — Timothy Edwards, Jr.
(74) *Attorney, Agent, or Firm* — Baker Botts L.L.P.

(57) ABSTRACT

A method and apparatus for controlling oil well drilling equipment is disclosed. One or more sensors are distributed in the oil well drilling equipment. Each sensor produces a signal. A surface processor coupled to the one or more sensors via a high speed communications medium receives the signals from the one or more sensors via the high speed communications medium. The surface processor is situated on or near the earth's surface. The surface processor includes a program to process the received signals and to produce one or more control signals. The system includes one or more controllable elements distributed in the oil well drilling equipment. The one or more controllable elements respond to the one or more control signals.

28 Claims, 13 Drawing Sheets

U.S. PATENT DOCUMENTS

| | | | | |
|---|---|---|---|---|
| 5,959,547 | A * | 9/1999 | Tubel et al. | 340/853.2 |
| 5,995,020 | A | 11/1999 | Owens et al. | 340/854.9 |
| 6,026,914 | A | 2/2000 | Adams et al. | 175/45 |
| 6,061,634 | A * | 5/2000 | Belani et al. | 702/12 |
| 6,079,505 | A | 6/2000 | Pignard et al. | 175/40 |
| 6,252,518 | B1 * | 6/2001 | Laborde | 340/855.4 |
| 6,257,332 | B1 * | 7/2001 | Vidrine et al. | 166/250.15 |
| 6,279,392 | B1 | 8/2001 | Shahin, Jr. et al. | 73/152.52 |
| 6,325,123 | B1 | 12/2001 | Gao et al. | 152/416 |
| 6,464,021 | B1 | 10/2002 | Edwards | 175/61 |
| 6,516,880 | B1 | 2/2003 | Otten et al. | 166/250.11 |
| 6,516,898 | B1 | 2/2003 | Krueger | 175/50 |
| 6,568,486 | B1 | 5/2003 | George | 175/45 |
| 6,581,455 | B1 | 6/2003 | Berger et al. | 73/152.52 |
| 7,145,472 | B2 * | 12/2006 | Lilly et al. | 340/853.3 |
| 2002/0017386 | A1 | 2/2002 | Ringgenberg et al. | 166/250.17 |
| 2002/0074165 | A1 | 6/2002 | Lee et al. | 175/48 |
| 2003/0209365 | A1 | 11/2003 | Downton | 175/50 |
| 2004/0039466 | A1 * | 2/2004 | Lilly et al. | 700/95 |
| 2004/0154831 | A1 * | 8/2004 | Seydoux et al. | 175/24 |
| 2005/0024231 | A1 | 2/2005 | Fincher | |
| 2005/0035875 | A1 * | 2/2005 | Hall et al. | 340/853.1 |
| 2005/0115741 | A1 * | 6/2005 | Terry et al. | 175/61 |

OTHER PUBLICATIONS

"IntelliPipe™ Technology: Wired for Speed and Durability," U.S. Department of Energy Office of Fossil Energy HTTP;//FOSSIL.ENERGY.GOV/NEWS/TECHLINES/03/TL_INTELLIPIPE_RMOTCTEST.HTML, Jun. 5, 2003.

Michael J. Jellison and David R. Hall, "Intelligent Drill Pipe Creates the Drilling Network," SPE International, SPE 80454, pp. 1-8, Presented At the SPE Asia Pacific Oil and Gas Conference and Exhibmon, Jakarta, Indonesia, Apr. 15-17, 2003.

A. Judzis, T. S. Green, G. M. Hoversten, and A. D. Black, "Seismic While Drilling for Enhanced Look-Ahead-Of-Bit Capabilities—Case Study of Successful Mud Pulse Coupling Demonstration," Society of Professional Engineers, SPE 63194, pp. 1-4, Presented At the 2000 SPE Annual Technical Conference and Exhibition Held in Dallas, Texas, Oct. 1-4, 2000.

Daniel C. Minette, Eric Molz, "Utilizing Acoustic Standoff Measurements to Improve the Accuracy of Density and Neutron Measurements," Society of Petroleum Engineers Inc., SPE 56447, pp. 1-14, Presented At the 1999 SPE Annual Technical Conference and Exhibition Held in Houston, Texas, Oct. 3-6, 1999.

"Telemetry Drill Pipe: Enabling Technology for the Downhole Internet," HTTP://WWW.INTELLIPIPE.COM/BROCHURES.ASP, Intellipipe Brochure 1.

"Telemetry Drill Pipe: Enabling Technology for the Downhole Internet," HTTP://WWW.INTELLIPIPE.COM/BROCHURES.ASP, Intellipipe Brochure 2.

International Search Report for PCT/US05/06470 Mailed Oct. 24, 2006.

U.S. Appl. No. 60/491,567, filed Jul. 31, 2003, Roger Fincher.

U.S. Appl. No. 60/478,237, filed Jun. 13, 2003, Roger Fincher.

U.S. Appl. No. 10/793,350, filed Mar. 4, 2004, Rodney, et al.

U.S. Appl. No. 10/793,537, filed Mar. 4, 2004, Dudley, et al.

U.S. Appl. No. 10/793,062, filed Mar. 4, 2005, Gleitman, et al.

U.S. Appl. No. 11/072,795, filed Mar. 4, 2005, Daniel Gleitman.

U.S. Appl. No. 11/051,762, filed Feb. 4, 2005, Daniel Gleitman.

U.S. Appl. No. 11/070,625, filed Mar. 2, 2005, Daniel Gleitman.

* cited by examiner

SURFACE REAL-TIME PROCESSING OF DOWNHOLE DATA

BACKGROUND

As oil well drilling becomes more and more complex, the importance of maintaining control over as much of the drilling equipment as possible increases in importance.

DETAILED DESCRIPTION

Figure 1:
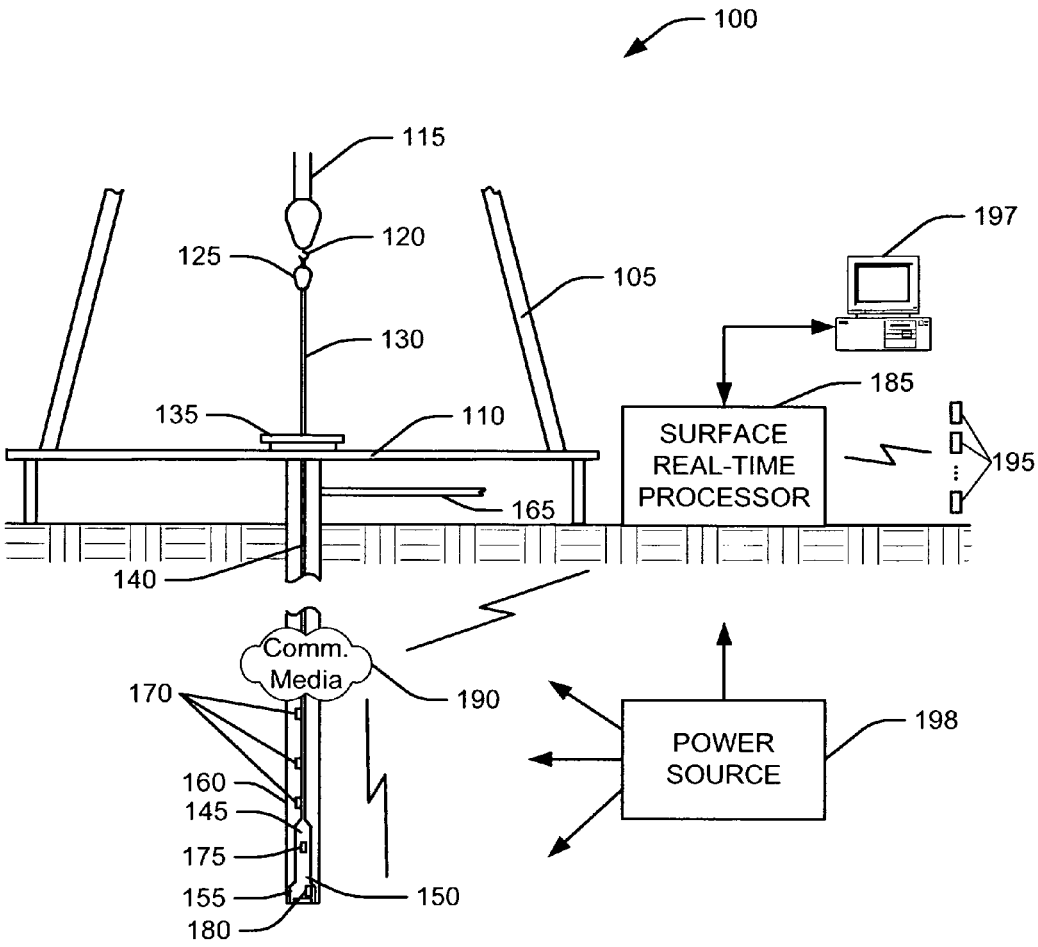
FIG. 1 shows a system for surface real-time processing of downhole data.

As shown in FIG. 1, oil well drilling equipment 100 (simplified for ease of understanding) includes a derrick 105, derrick floor 110, draw works 115 (schematically represented by the drilling line and the traveling block), hook 120, swivel 125, kelly joint 130, rotary table 135, drill string 140, drill collar 145, LWD tool or tools 150, and drill bit 155. Mud is injected into the swivel by a mud supply line (not shown). The mud travels through the kelly joint 130, drill string 140, drill collars 145, and LWD tool(s) 150, and exits through jets or nozzles in the drill bit 155. The mud then flows up the annulus between the drill string and the wall of the borehole 160. A mud return line 165 returns mud from the borehole 160 and circulates it to a mud pit (not shown) and back to the mud supply line (not shown). The combination of the drill collar 145, LWD tool(s) 150, and drill bit 155 is known as the bottomhole assembly (or "BHA"). In one embodiment of the invention, the drill string is comprised of all the tubular elements from the earth's surface to the bit, inclusive of the BHA elements. In rotary drilling the rotary table 135 may provide rotation to the drill string, or alternatively the drill string may be rotated via a top drive assembly. The term "couple" or "couples" used herein is intended to mean either an indirect or direct connection. Thus, if a first device couples to a second device, that connection may be through a direct connection, or through an indirect electrical connection via other devices and connections.

A number of downhole sensor modules and downhole controllable elements modules 170 are distributed along the drill string 140, with the distribution depending on the type of sensor or type of downhole controllable element. Other downhole sensor modules and downhole controllable element modules 175 are located in the drill collar 145 or the LWD tools. Still other downhole sensor modules and downhole controllable element modules 175 are located in the bit 180. The downhole sensors incorporated in the downhole sensor modules, as discussed below, include acoustic sensors, magnetic sensors, gravitational field sensors, gyroscopes, calipers, electrodes, gamma ray detectors, density sensors, neutron sensors, dipmeters, resistivity sensors, imaging sensors, weight on bit, torque on bit, bending moment at bit, vibration sensors, rotation sensors, rate of penetration sensors (or WOB, TOB, BOB, vibration sensors, rotation sensors or rate of penetration sensors distributed along the drillstring), and other sensors useful in well logging and well drilling. The downhole controllable elements incorporated in the downhole controllable element modules, as discussed below, include transducers, such as acoustic transducers, or other forms of transmitters, such as x-ray sources, gamma ray sources, and neutron sources, and actuators, such as valves, ports, brakes, clutches, thrusters, bumper subs, extendable stabilizers, extendable rollers, extendible feet, etc. To be clear, even sensor modules that do not incorporate an active source may still for purposes herein be considered to be controllable elements. Preferred embodiments of many of the sensors discussed above and throughout may include controllable acquisition attributes such as filter parameters, dynamic range, amplification, attenuation, resolution, time window or data point count for acquisition, data rate for acquisition, averaging, or synchronicity of data acquisition with related parameter (e.g. azimuth). Control and varying of such parameters improves the quality of the individual measurements, and allows for a far richer data set for improved interpretations. Additionally, the manner in which any particular sensor module communicates may be controllable. A particular sensor module's data rate, resolution, order, priority, or other parameter of communication over the communication media (discussed below) may be deliberately controlled, in which case that sensor too is considered a controlled element for purposes herein.

The sensor modules and downhole controllable element modules communicate with a surface real-time processor 185 through communications media 190. The communications media can be a wire, a cable, a waveguide, a fiber, or any other media that allows high data rates. Communications over the communications media 190 can be in the form of network communications, using, for example Ethernet, with each of the sensor modules and downhole controllable element modules being addressable individually or in groups. Alternatively, communications can be point-to-point. Whatever form it takes, the communications media 190 provides high speed data communication between the devices in the borehole 160 and the one or more surface real-time processors. Preferably, the communication and addressing protocols are of a type that is not computationally intensive, so as to drive a relatively minimal hardware requirement dedicated downhole to the communication and addressing function, as discussed further below.

The surface real-time processor 185 may have data communication, via communications media 190 or via another route, with surface sensor modules and surface controllable element modules 195. The surface sensors, which are incorporated in the surface sensor modules as discussed below, may include, for example, hook load (for weight-on-bit) sensors and rotation speed sensors. The surface controllable elements, which are incorporated in the surface controllable element modules, as discussed below, include, for example, controls for the draw works 115 and the rotary table 135.

The surface real-time processor 185 may also include a terminal 197, which may have capabilities ranging from those of a dumb terminal to those of a workstation. The terminal 197 allows a user to interact with the surface real-time processor 185. The terminal 197 may be local to the surface real-time processor 185 or it may be remotely located and in communication with the surface real-time processor 185 via telephone, a cellular network, a satellite, the Internet, another network, or any combination of these.

The oil well drilling equipment may also include a power source 198. Power source 198 is shown in FIG. 1 as being ambiguously located to convey the idea that the power source can be (a) located at the surface with the surface processor; (b) located in the borehole; or (c) distributed along the drill string or a combination of those configurations. If it is on the surface, the power source may be the local power grid, a generator or a battery. If it is in the borehole the power source may be an alternator, which may be used to convert the energy in the mud flowing through the drill string into electrical energy, or it may be one or more batteries or other energy storage devices. Power may be generated downhole using a turbine driven by mud flow or by pressure differential being used, for example, to set a spring.

Figure 2:
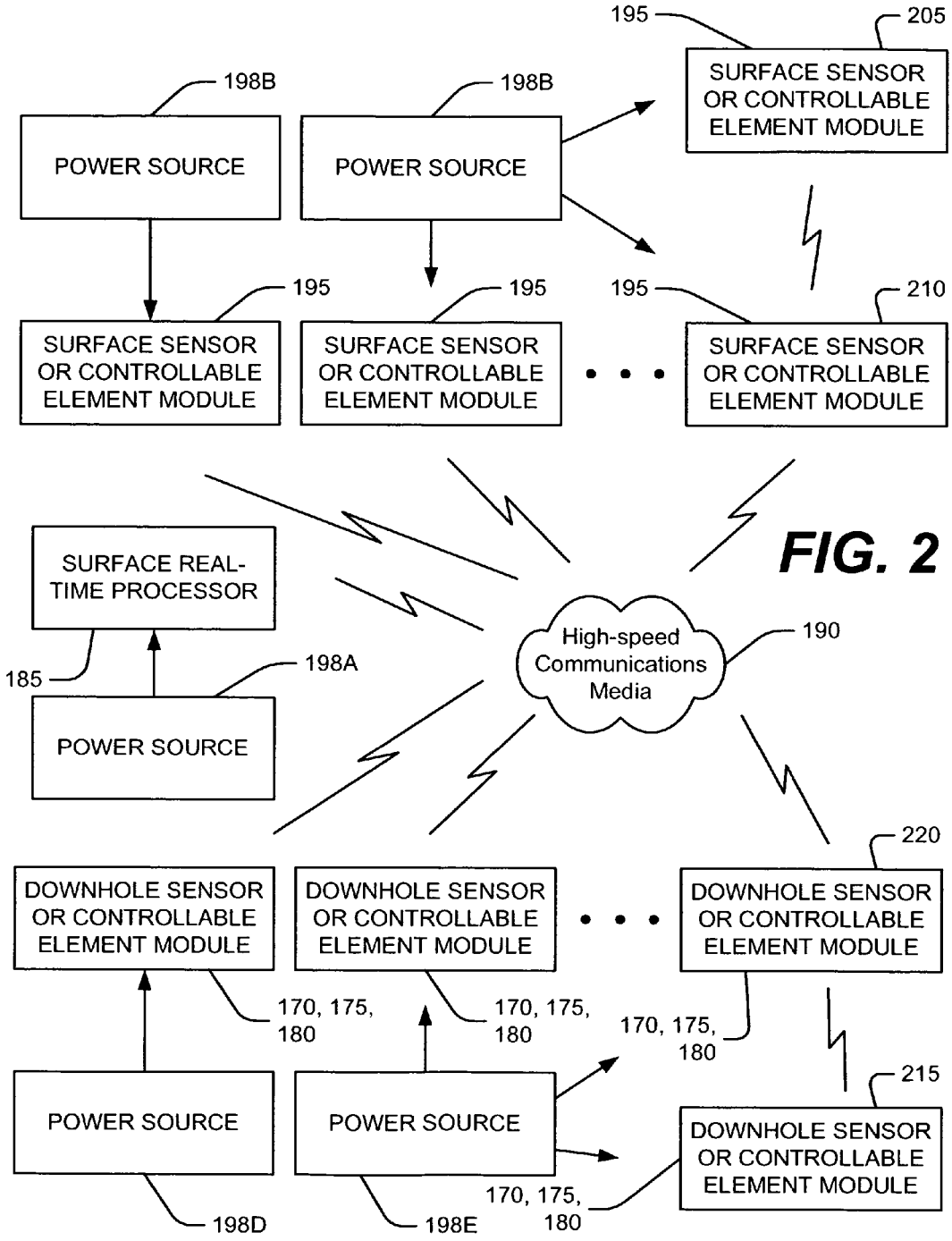
FIG. 2 shows a logical representation of a system for surface real-time processing of downhole data.

As illustrated by the logical schematic of the system in FIG. 2, the high speed communications media 190 provides high speed communications between the surface sensors and controllable elements 195, and/or the downhole sensor modules and controllable element modules 170, 175, 180, and the surface real-time processor 185. In some cases, the communications from one downhole sensor module or controllable element module 215 may be relayed through another downhole sensor module or downhole controllable element module 220. The link between the two downhole sensor modules or downhole controllable element modules 215 and 220 may be part of the communications media 190. Similarly, communications from one surface sensor module or surface controllable element module 205 may be relayed through another surface sensor module or surface controllable element module 210. The link between the two surface sensor modules or surface controllable element modules 205 and 210 may be part of the communications media 190.

The high speed communications media 190 may be a single communications path or it may be more than one. For example, one communications path, e.g. cabling, may connect the surface sensors and controllable elements 195 to the surface real-time processor 185. Another, e.g. wired pipe, may connect the downhole sensors and controllable elements 170, 175, 180 to the surface real-time processor 185.

The communications media 190 is labeled "high speed" on FIG. 2. This designation indicates that the communications media 190 operates at a speed sufficient to allow real-time control, e.g., at wire-speed, through the surface real time processor 185, of the surface controllable elements and the downhole controllable elements based on signals from the surface sensors and the surface controllable elements. Generally, the high speed communications media 190 provides communications at a rate greater than that provided by mud telemetry, acoustic telemetry, or electromagnetic (EM) telemetry. In some example systems, the high speed communications are provided by wired pipe, which at the time of filing was capable of transmitting data at a rate of up to approximately 1 megabit/second. Considerably higher data rates are expected in the future and fall within the scope of this disclosure and the appended claims. It is recognized that mechanical connections between segments of the communications path, addressing and other overhead functions, and other practical implementation factors may reduce the actual data rate attained substantially from these megabit ideals. So long as the effective data transmission rates are substantially higher than those available through mud, acoustic, and EM telemetry (i.e. substantially above 10-100 Hz), and sufficient for the new measurement and control purposes contemplated herein, they are deemed for purposes of this application to be "high speed". For many of the measurement and control purposes contemplated herein, a 1000 Hz data rate would fulfill these requirement. Likewise, the term "real time" as used herein to describe various processes is intended to have an operational and contextual definition tied to the particular processes, such process steps being sufficiently timely for facilitating the particular new measurement or control process herein focused upon. For example, in the context of drill pipe being rotated at 120 revolutions per minute (RPM), and an improved measurement process providing for azimuthal resolution of 5 degrees, a "real time" series of process steps would occur sufficiently timely in context of the 1/144 of a second duration for that 5 degrees of rotation.

In one embodiment of the invention, the outputs from the sensors are transmitted to the surface real-time processor in a particular sequence, in other embodiments of the invention the transmission of the outputs of the sensors to the surface real-time processor is in response to a query addressed to a particular sensor by surface real-time processor 185. Similarly, outputs to the controllable elements modules may be sequenced or individually addressed. In one embodiment of the invention, communications between the sensors and the surface real-time processor is via the Transmission Control Protocol (TCP), the Transmission Control Protocol/Internet Protocol (TCP/IP), or the User Datagram Protocol (UDP). By using one or more of these protocols, the surface real-time processor may be locally disposed at the surface of the well bore or remotely disposed at any location on the earth's surface.

The power source 198 is illustrated in FIG. 2 in several ways, designated by references 198A . . . E. For example, power source 198A may be on the surface with, and may provide power to, the surface real-time processor 185. In addition, the power source 198A may provide power from the surface to other oil well drilling equipment located at or near the surface or throughout the borehole. The power could be provided from this surface via an electric line or via a high power fiber optic cable with power converters at the locations where power is to be delivered.

Power source 198B may be co-located with and provide power to a single surface sensor or controllable element module 185. Alternatively, power source 198C may be co-located with one surface sensor and controllable element module 185 and provide power for more than one surface sensor or controllable element module 185.

Similarly, power source 198D may be co-located with and provide power to a single downhole sensor or controllable element module 185. Alternatively, power source 198E may be co-located with one downhole sensor and controllable element module 185 and provide power for more than one downhole sensor or controllable element module 185.

Figure 3:
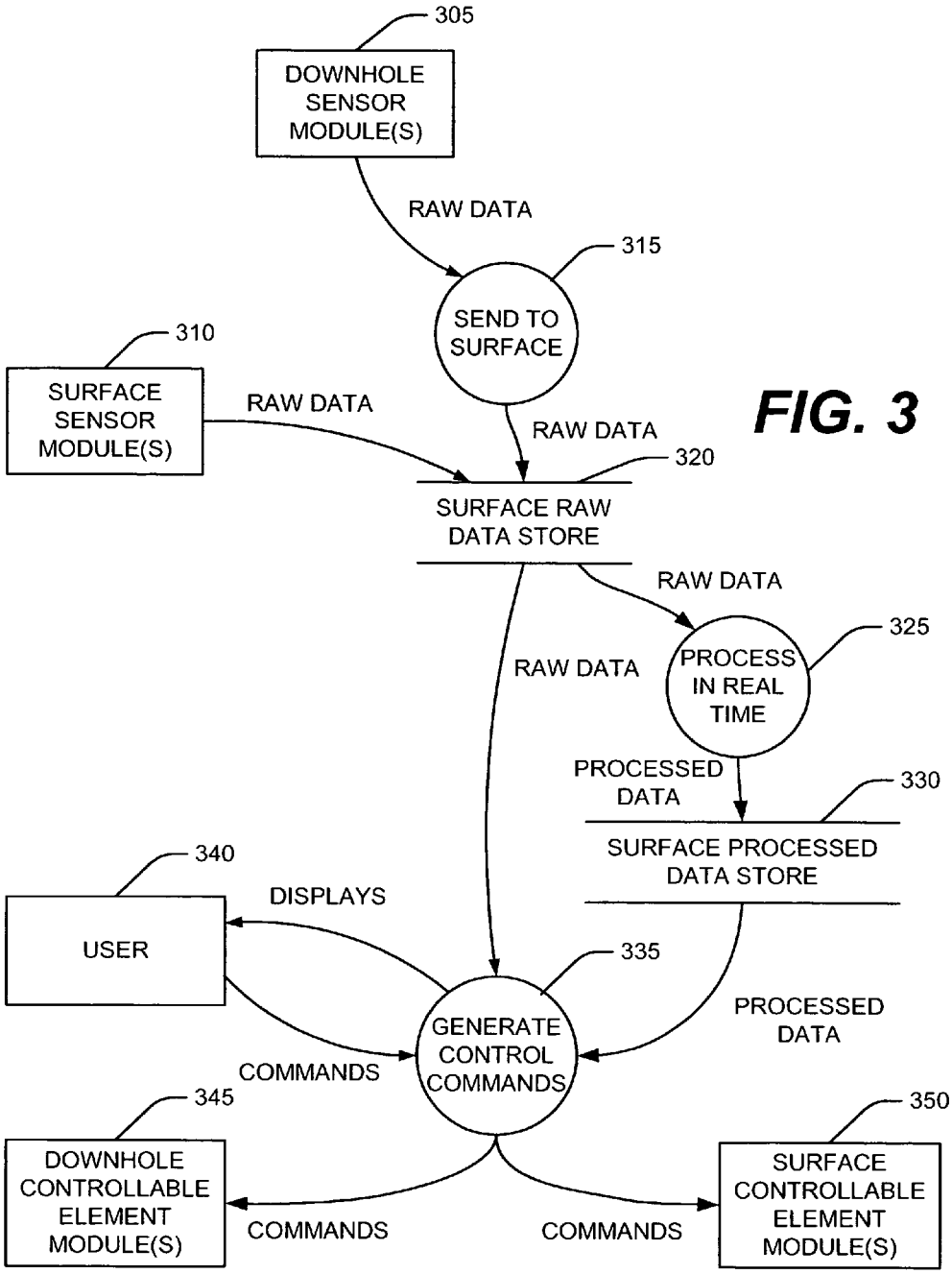
FIG. 3 shows a data flow diagram for a system for surface real-time processing of downhole data.

A general system for real-time control of downhole and surface logging while drilling operations using data collected from downhole sensors and surface sensors, illustrated in FIG. 3, includes downhole sensor module(s) 305 and surface sensor module(s) 310. Raw data is collected from the downhole sensor module(s) 305 and sent to the surface (block 315) where it may be stored in a surface raw data store 320. Similarly, raw data is collected from the surface sensor module(s) 310 and may be stored in the surface raw data store 320. Raw data store 320 may be transient memory such as random access memory (RAM), or persistent memory, e.g., read only memory (ROM), or magnetic or optical storage media.

Raw data from the surface raw data store 320 is then processed in real time (block 325) and the processed data may be stored in a surface processed data store 330. The processed data is used to generate control commands (block 335). In some cases, the system provides displays to a user 340 through, for example, terminal 197, who can influence the generation of the control commands. The control commands are used to control downhole controllable elements 345 and/or surface controllable elements 350. In one embodiment of the invention the control commands are automatically generated, e.g., by real time processor 185, during or after processing of the raw data and the control commands are used to control the downhole controllable elements 345 and/or surface controllable elements 350.

In many cases, the control commands produce changes or otherwise influence what is detected by the downhole sensors and/or the surface sensors, and consequently the signals that they produce. This control loop from the sensors through the real-time processor to the controllable elements and back to the sensors allows intelligent control of logging while drilling operations. In many cases, as described below, proper operation of the control loops requires a high speed communication media and a real-time surface processor.

Generally, the high-speed communications media 190 permits data to be transmitted to the surface where it can be processed by the surface real-time processor 185. The surface real-time processor 185, in turn, may produce commands that can be transmitted at least to the downhole sensors and downhole controllable elements to affect the operation of the drilling equipment. Surface real-time processor 185 may be any of a wide variety of general purpose processors or microprocessors (such as the Pentium® family of processors manufactured by Intel® Corporation), a special purpose processor, a Reduced Instruction Set Computer (RISC) processor, or even a specifically programmed logic device. The real-time processor may comprise a single microprocessor based computer, or a more powerful machine with multiple multiprocessors, or may comprise multiple processor elements networked together, any or all of which may be local or remote to the location of the drilling operation.

Moving the processing to the surface and eliminating much, if not all, of the downhole processing makes it possible in some cases to reduce the diameter of the drill string producing a smaller diameter well bore than would otherwise be reasonable. This allows a given suite of downhole sensors (and their associated tools or other vehicles) to be used in a wider variety of applications and markets.

Further, locating much, if not all, of the processing at the surface reduces the number of temperature-sensitive components that operate in the severe environment encountered as a well is being drilled. Few components are available which operate at high temperatures (above about 200° C.) and design and testing of these components is very expensive. Hence, it is desirable to use as few high temperature components as possible.

Further, locating much, if not all, of the processing at the surface improves the reliability of the downhole tool design because there are fewer downhole parts. Further, such designs allow a few common elements to be incorporated in an array of sensors. This higher volume use of a few components results in a cost reduction in these components.

Figure 4:
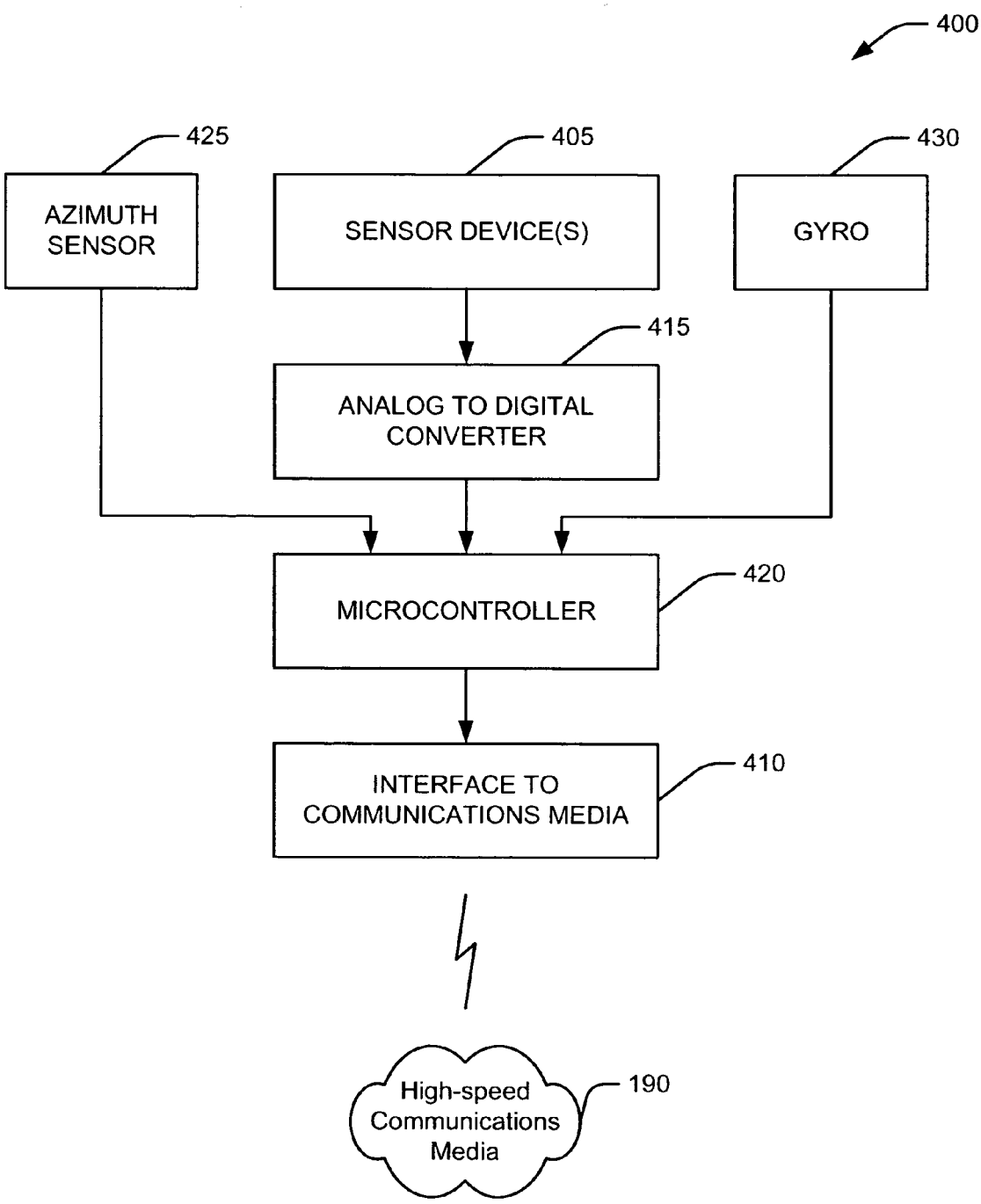
FIG. 4 shows a block diagram for a sensor module.
Figure 6:
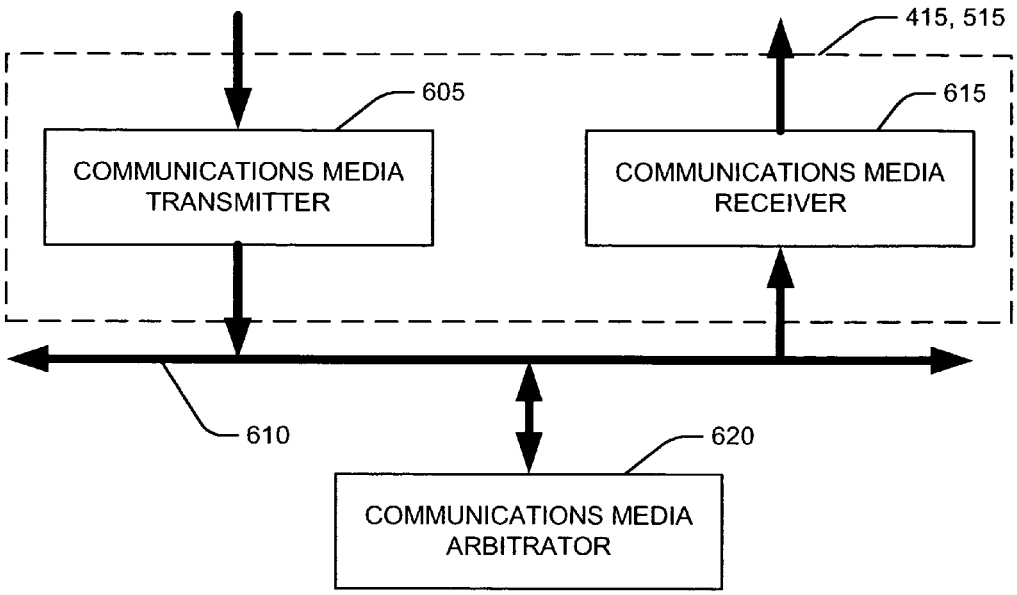
FIGS. 6 and 7 show block diagrams of interfaces to the communications media.
Figure 7:
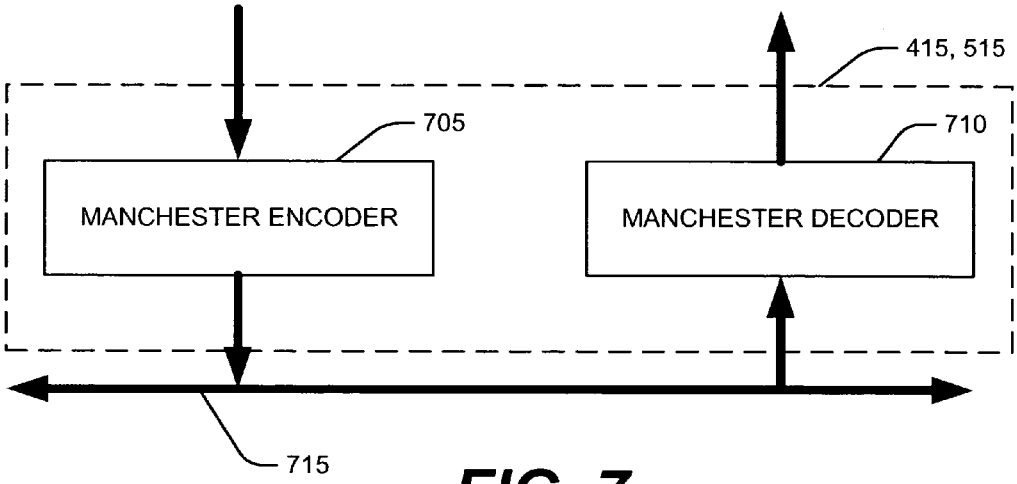

An example sensor module 400, illustrated in FIG. 4, includes, at a minimum, a sensor device or devices 405 and an interface to the communications medium 410 (which is described in more detail with respect to FIGS. 6 and 7). In most cases, the output of each sensor device 405 is an analog signal and generally the interface to the communications media 410 is digital. An analog to digital converter (ADC) 415 is provided to make that conversion. If the sensor device 405 produces a digital output or if the interface to the communications media 410 can communicate an analog signal through the communications media 190, the ADC 415 is not necessary.

A microcontroller 420 may also be included. If it is included, the microcontroller 420 manages some or all of the other devices in the example sensor module 400. For example, if the sensor device 405 has one or more controllable parameters, such as frequency response or sensitivity, the microcontroller 420 may be programmed to control those parameters. The control may be independent, based on programming included in memory attached to the microcontroller 420, or the control may be provided remotely through the high-speed communications media 190 and the interface to the communications media 410. Alternatively, if a microcontroller 420 is not present, the same types of controls may be provided through the high-speed communications media 190 and the interface to communications media 410. The microcontroller, if included, may additionally handle the particular sensor or other device's addressing and interface to the high-speed communications media. Microcontrollers such as members of the PICmicro® family of microcontrollers from Microchip Technology Inc. with a limited (as compared to the real-time processor described earlier) but adequate capability for the limited downhole control purposes set out herein are capable of high efficiency packaging and high temperature operation.

The sensor module 400 may also include an azimuth sensor 425, which produces an output related to the azimuthal orientation of the sensor module 400, which may be related to the orientation of the drill string if the sensor modules are coupled to the drill string. Data from the azimuth sensor 425 is compiled by the microcontroller 420, if one is present, and sent to the surface through the interface to the communications media 410 and the high-speed communications media 190. Data from the azimuth sensor 425 may need to be digitized before it can be presented to the microcontroller 420. If so, one or more additional ADCs (not shown) would be included for that purpose. At the surface, the surface processor 185 combines the azimuthal information with other information related to the depth of the sensor module 400 to identify the location of the sensor module 400 in the earth. As that information is compiled, the surface processor (or some other processor) can compile a good map of the particular borehole parameters measured by sensor module 400.

The sensor module 400 may also include a gyroscope 430, which may provide true geographic orientation information rather than Just the magnetic orientation information provided by the azimuth sensor 425. Alternately, one or more gyroscopes or magnetometers disposed along the drill pipe may provide the angular velocity of the drill pipe at each location of the gyroscope. The information from the gyroscope is handled in the same manner as the azimuthal information from the azimuth sensor, as described above. The sensor module 400 may also include one or more accelerometers. These are used to compensate the gyro for motion and to provide an indication of the inclination and gravity tool face of the survey tool.

Figure 5:
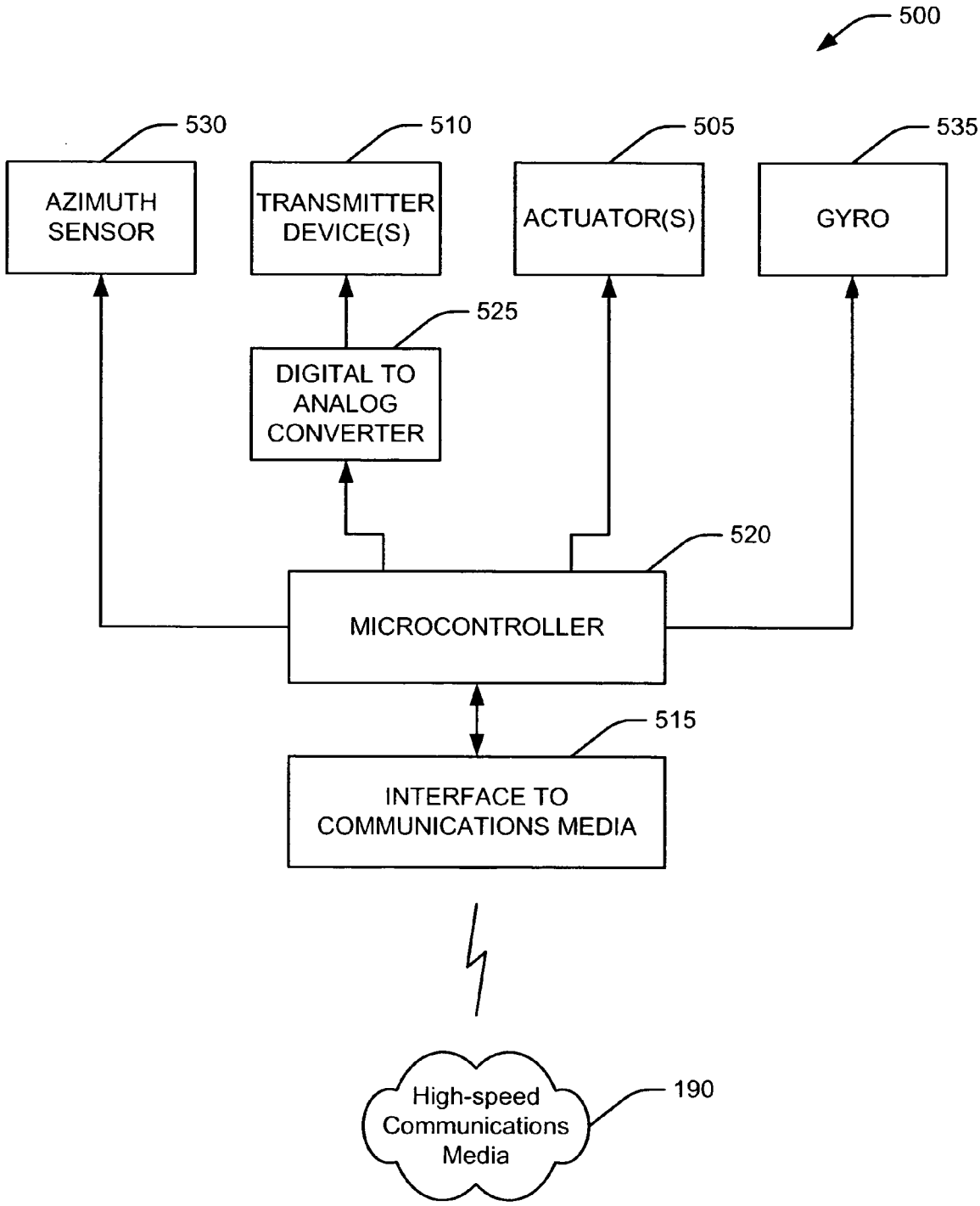
FIG. 5 shows a block diagram for a controllable element module.

An example controllable element module 500, shown in FIG. 5, includes, at a minimum, an actuator 505 and/or a transmitter device or devices 510 and an interface to the communications media 515. The actuator 505 is one of the actuators described above and may be activated through application of a signal from, for example, a microcontroller 520, which is similar in function to the microcontroller 420 shown in FIG. 4. The transmitter device is a device that transmits a form of energy in response to the application of an analog signal. An example of a transmitter device is a piezoelectric acoustic transmitter that converts an analog electric signal into acoustic energy by deforming a piezoelectric crystal. In the example controllable element module 500 illustrated in FIG. 5, the microcontroller 520 generates the signal that is to drive the transmitter device 510. Generally, the microcontroller generates a digital signal and the transmitter device is driven by an analog signal. In those instances, a digital-to-analog converter ("DAC") 525 is necessary to convert the digital signal output of the microcontroller 520 to the analog signal to drive the transmitter device 510.

The example controllable element module 500 may include an azimuth sensor 530 or a gyroscope 535, which are similar to those described above in the description of the sensor module 400, or it may include an inclination sensor, a tool face sensor, a vibration sensor or a standoff sensor.

The interface to the communications media 415, 515 can take a variety of forms. In general, the interface to the communications media 415, 515 is a simple communication device and protocol built from, for example, (a) discrete components with high temperature tolerances or (b) from programmable logic devices (PLDs) with high temperature tolerances, or (c) the microcontroller with associated limited high temperature memory module discussed earlier with high temperature tolerances.

The interface to the communications media 415, 515 may take the form illustrated in FIG. 6. In the example shown in FIG. 6, the interface to the communications media 415, 515 includes a communications media transmitter 605 which receives digital information from within the sensor module 400 or the controllable element module 500 and applies it to a bus 610. A communications receiver 615 receives digital information from the bus and provides it to the remainder of the sensor module 400 or the controllable element module 500. A communications media arbitrator 620 arbitrates access to the bus. Thus, the arrangement in FIG. 6 can be accomplished with a variety of conventional networking schemes, including Ethernet, and other networking schemes that include a communications arbitrator 620.

Preferably, however, the interface to communications media 415, 515 is a simple device, as illustrated in FIG. 7. It includes a Manchester encoder 705 and a Manchester decoder 710. The Manchester encoder accepts digital information from the sensor module 400 or the controllable element module 500 and applies it to a bus 715. The Manchester decoder 710 takes the digital data from the bus 715 and provides it to the sensor module 400 or controllable element module 500. The bus 715 can be arranged such that it is connected to all sensor modules 400 and all controllable element modules 500, in which case a collision avoidance technique would be applied. For example, the data from the various sensor modules 400 and controllable element modules 500 could be multiplexed, using a time division multiplex scheme or a frequency division multiplex scheme. Alternatively, collisions could be allowed and sorted out on the surface using various filtering techniques. Other simple communications protocols that could be applied to the interface to the communications media 415, 515 include the Discrete Multitone protocol and the VDSL (Very High Rate Digital Subscriber Line) CDMA (Code Division Multiple Access) protocol.

Alternatively, each sensor module 400 and each controllable element module 500 could have a dedicated connection to the surface, using for example a single conductor of a multi-conductor cable or a single strand of a multi-stranded optical cable.

The overall approach to the sensor module 400 and the controllable element module 500 is to simplify the downhole processing and communication elements and to move the complex processing and electronics to the surface. In one embodiment of the invention, the complex processing is done at a location remotely disposed from the high temperatures of the drilling environment, e.g., nearer the surface end of the drill string. We use the term "surface processor" herein to mean the real time processor as defined earlier. However, while locating the real-time processor fully at surface may be preferred in many circumstances, there may be advantages in certain applications to locating part or all of the real-time processor near but not necessarily at surface, or on or near the sea bed, but in all cases remote from the high temperature drilling environment.

Figure 8:
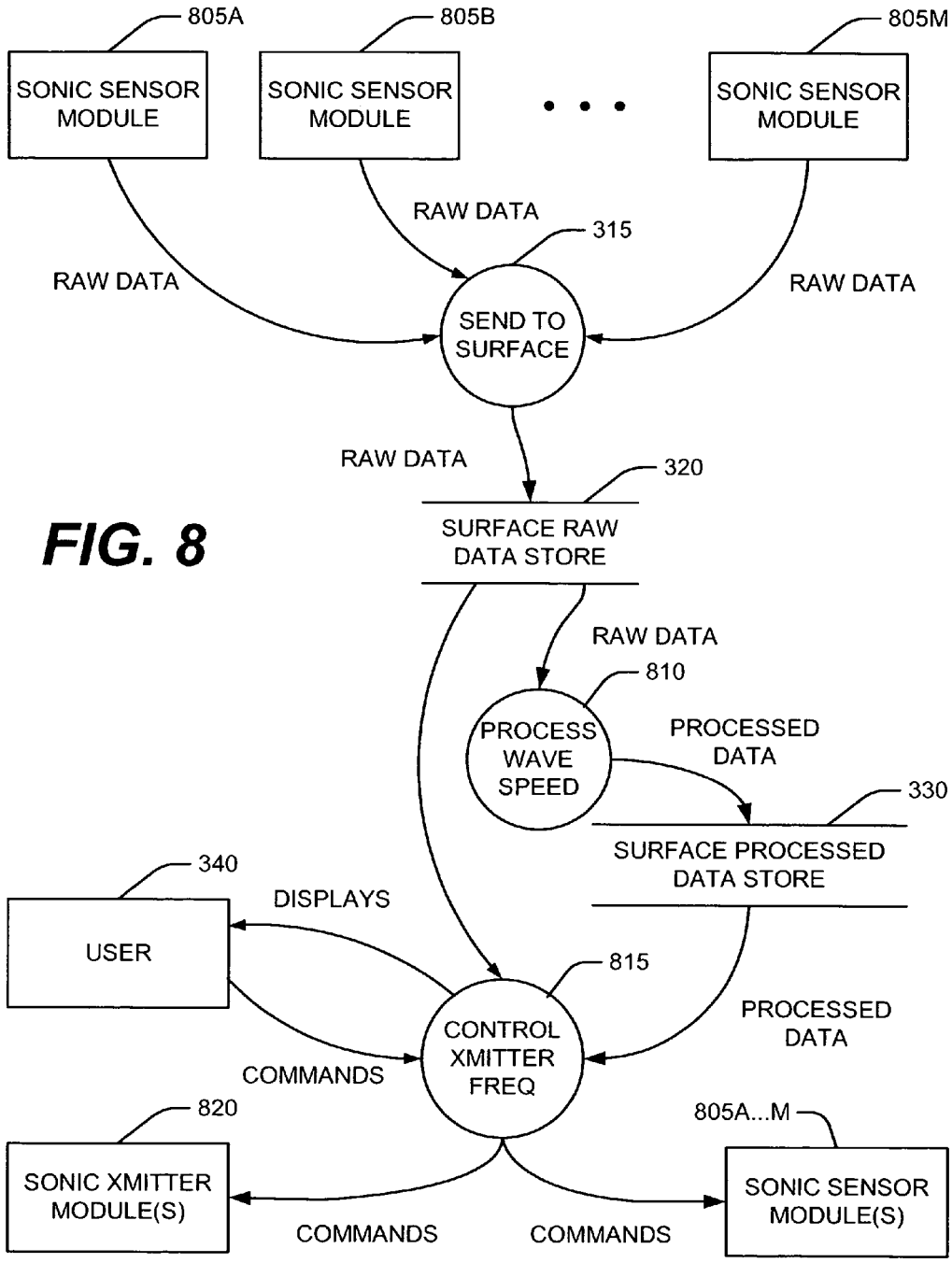
FIGS. 8-14 show a data flow diagrams for systems for surface real-time processing of downhole data.
Figure 9:
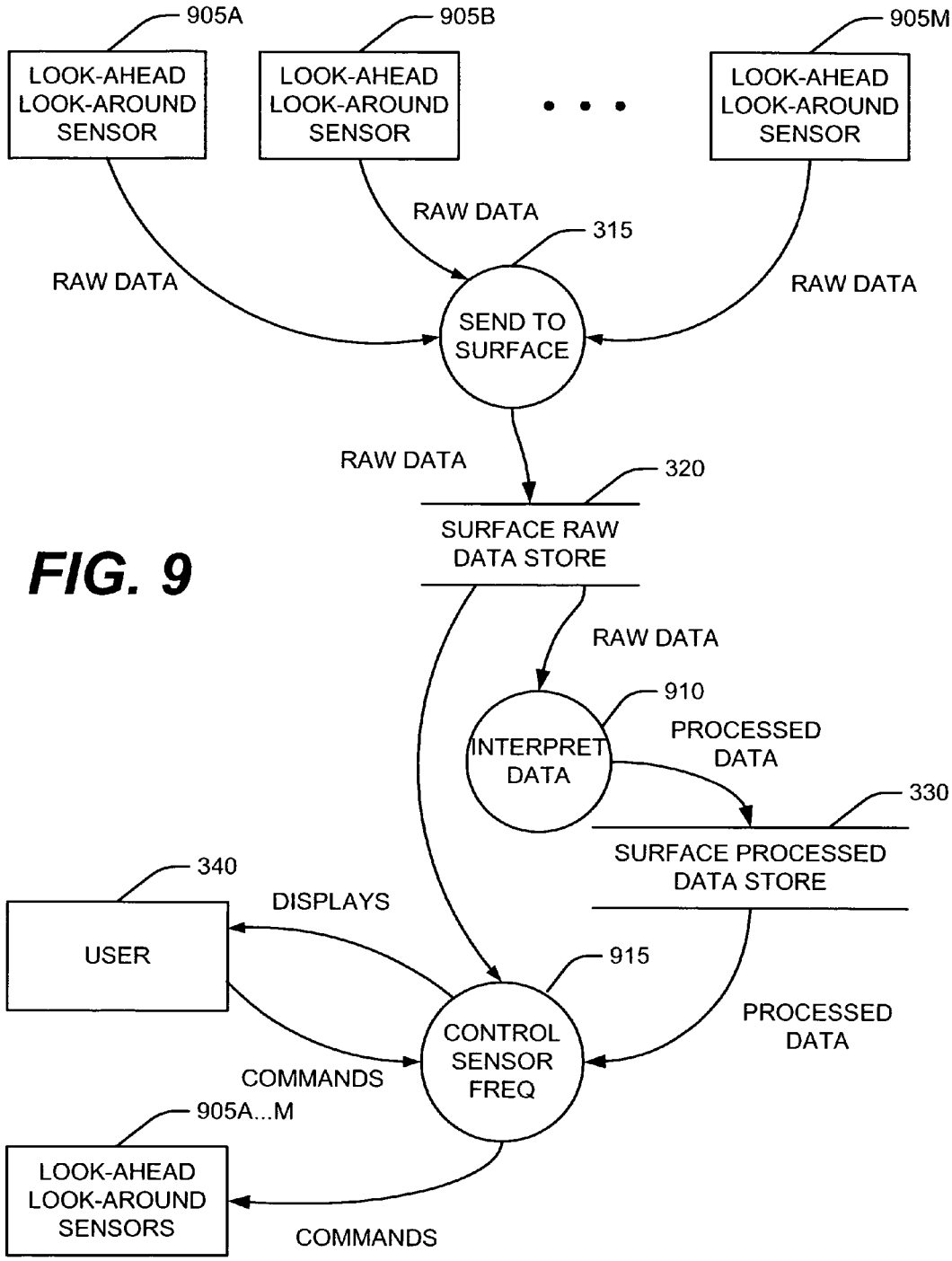

The apparatus and method illustrated in FIGS. 2 and 3 can be applied to a large number of logging while drilling or measurement while drilling applications. For example, as illustrated in FIG. 8, the apparatus and method can be applied to sonic logging while drilling. For example, as illustrated in FIG. 8, sonic sensor modules 805A . . . M emit acoustic energy and sense acoustic energy from the formations around the drill string where the sensor modules are located, although in some applications the sonic sensor modules 805A . . . M do not emit energy. In those cases, the sonic energy detected is generated by another source, such as, for example, the action of the bit in the borehole. The sensor modules produce raw data. The raw data is sent to the surface (block 315) where it is stored in the surface raw data store (block 320). The raw data is processed to determine wave speed in the formations surrounding the drill string where the sonic sensor modules 805A . . . M are located (block 810).

Real-time measurement of compressional wave speed is usually possible with downhole hardware, but real-time measurement of shear wave speed or measurement of other downhole modes of sonic energy propagation requires significant analysis. By moving the raw data to the surface in real time, it is possible to apply the significant power provided by the surface real-time processor 185. The resulting processed data is stored in the surface process data store 330. In some cases, real-time analysis would indicate that it is desirable to change the operating frequency of the sensor and the transmitter in order to get a more accurate or a less ambiguous measurement. To accomplish this, the data in the surface processed data store 330 is processed to determine if the frequency or frequencies being used by the sonic transmitters should be changed (block 815). This processing may produce commands that are provided to sonic transmitter modules 820, if they are being used to generate the sonic energy, and to the sonic sensor modules 805A . . . M. Further, the user 340 may be provided with displays which illustrate operation of the sonic logging while drilling system. The system may allow the user to provide commands to modify that operation.

The same apparatus and methods can be applied to look-ahead/look-around sensors. Look-ahead sensors are intended to detect a formation property or a change in a formation property ahead of the bit, ideally tens of feet or more ahead of the bit. This information is important for drilling decisions, for example recognizing an upcoming seismic horizon and possible highly pressured zone in time to take precautionary measures (e.g. weighting up the mud) before the bit encounters such zone. Look-around sensors take this concept to the next level, not just detecting properties straight ahead of the bit, but also tens of feet to the sides (i.e. radially). The look-around concept may be especially applicable to steering through horizontal zones where the properties above and below may be even more important than that ahead of the bit, e.g. in geophysical steering through particular fault blocks and other structures. Look-around sensors are most useful when they have azimuthal capability, which means that they produce very large volumes of data. Because of non-uniqueness of interpretation of these data, they should be interpreted at the surface, with assistance from an expert. Generally, two types of technology have been used for such measurements (with various combinations of these two technologies, such as in electroseismics): (1) acoustic look-ahead/look-around; and (2) electromagnetic look-ahead/look-around (including borehole radar sensors). Information from look-ahead/look-around sensors 905A . . . M is gathered and converted into raw data which is sent to the surface (block 315). The raw data is stored in the surface raw data store (block 320) and interpreted (block 910). The processed data is stored in the surface process data store (block 330) and a process to control, for example, the frequency of the look-ahead/look-around sensors 905A . . . M (block 915) produces the necessary command to accomplish that function. As before, the system provides the user 340 with displays and accepts commands from the user.

The interpretation of data process (block 910), which is performed by the surface real-time processor 185, allows interpretation and processing to identify reflections and mode conversions of acoustic and electromagnetic waves. Surface processing allows dynamic control of the look-ahead/look-around sensors and the associated transmitters. If the look-ahead/look-around sensor 905A . . . M is an acoustic device, each channel may be sampled at a frequency on the order of 5,000 samples per second. Suppose there are 14 such channels, and each channel is digitized to 16 bits (a very conservative value). Then the data rate for the acoustic signals alone is 140K bytes per second. Most of the proposed electromagnetic systems operate a bit differently, but would achieve similar effective sampling rates, while combined systems (EM+acoustic) would require even higher data rates. For some implementations, these estimates may be low by more than an order of magnitude. Enough data must be acquired to unambiguously identify the direction and relative depth of all reflectors. Having the processing at surface rather than downhole enables this raw processing, the modifying of the data acquisition parameters as required, but also allows the marriage of these downhole data to surface data and interpretations already available, such as a surface seismics-based earth model. With such a marriage of data sources at surface better interpretations can be made.

Figure 10:
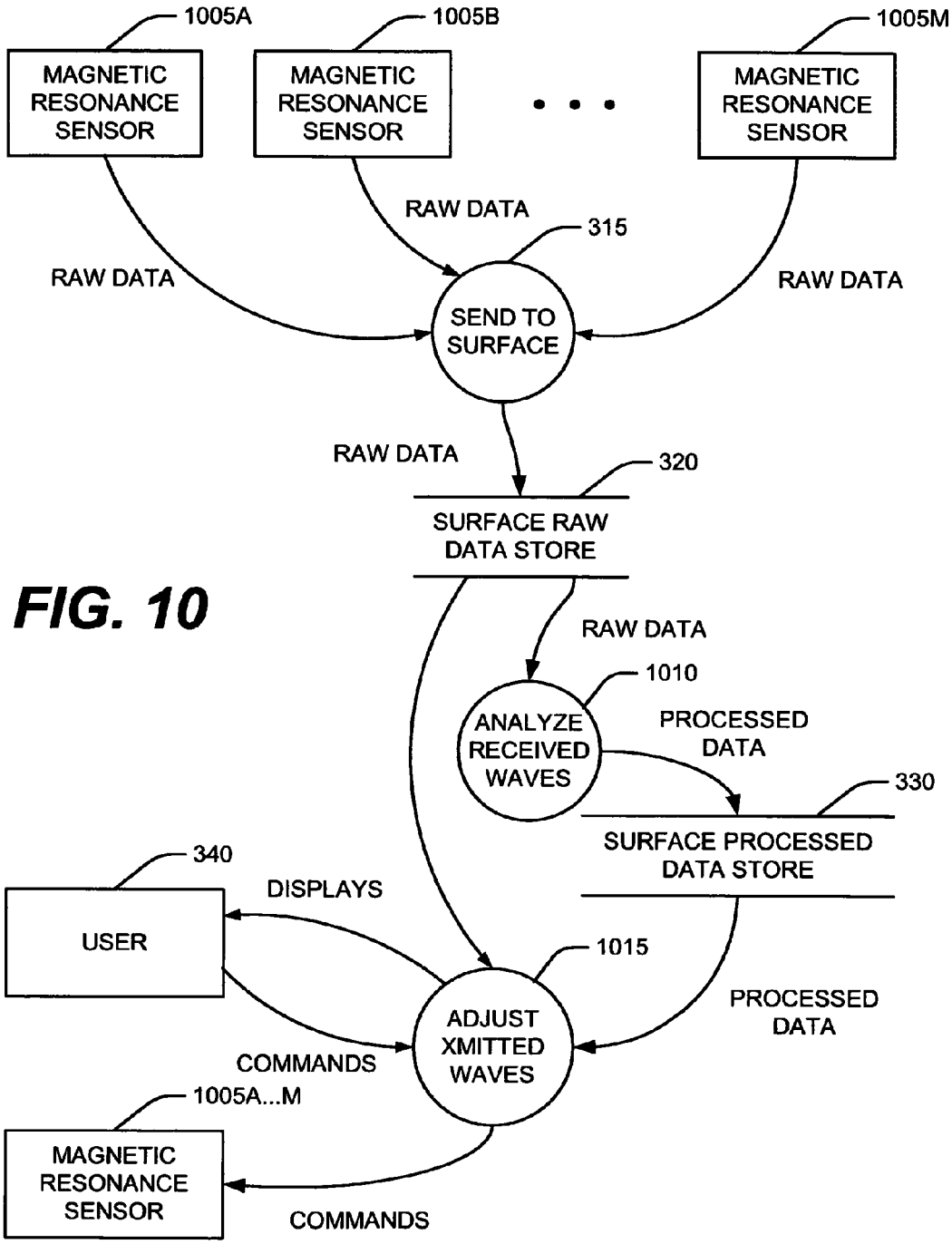

Similarly, as illustrated in FIG. 10, magnetic resonance while drilling can be accomplished using a similar arrangement of sensors and processing. Magnetic resonance sensors 1005A . . . M generate raw data which is digitized and transmitted to the surface (block 320). Because of the high data rate available from the high speed communications media 190, the raw data transmitted to the surface can represent the full received wave form rather than an abbreviated wave form. The raw data is stored in a surface raw data store (block 320). The raw data is analyzed (block 1010), which is possible with greater precision than is conventional because raw data representing the entire wave is received, and the processed data is stored in a surface processed data store (block 330). The data stored in the surface processed data store at 330 is further processed to determine how best to adjust the transmitted waves (block 1015). The process for adjusting transmitted waves (block 1015) provides displays to a user 340 and receives commands from the user that are used to modify the process for adjusting transmitted waves (block 1015). The process for adjusting the transmitted waves (block 1015) produces commands that are transmitted to the magnetic resonance sensors 1005A . . . M, which modify the performance characteristics of the magnetic resonance sensors.

Figure 11:
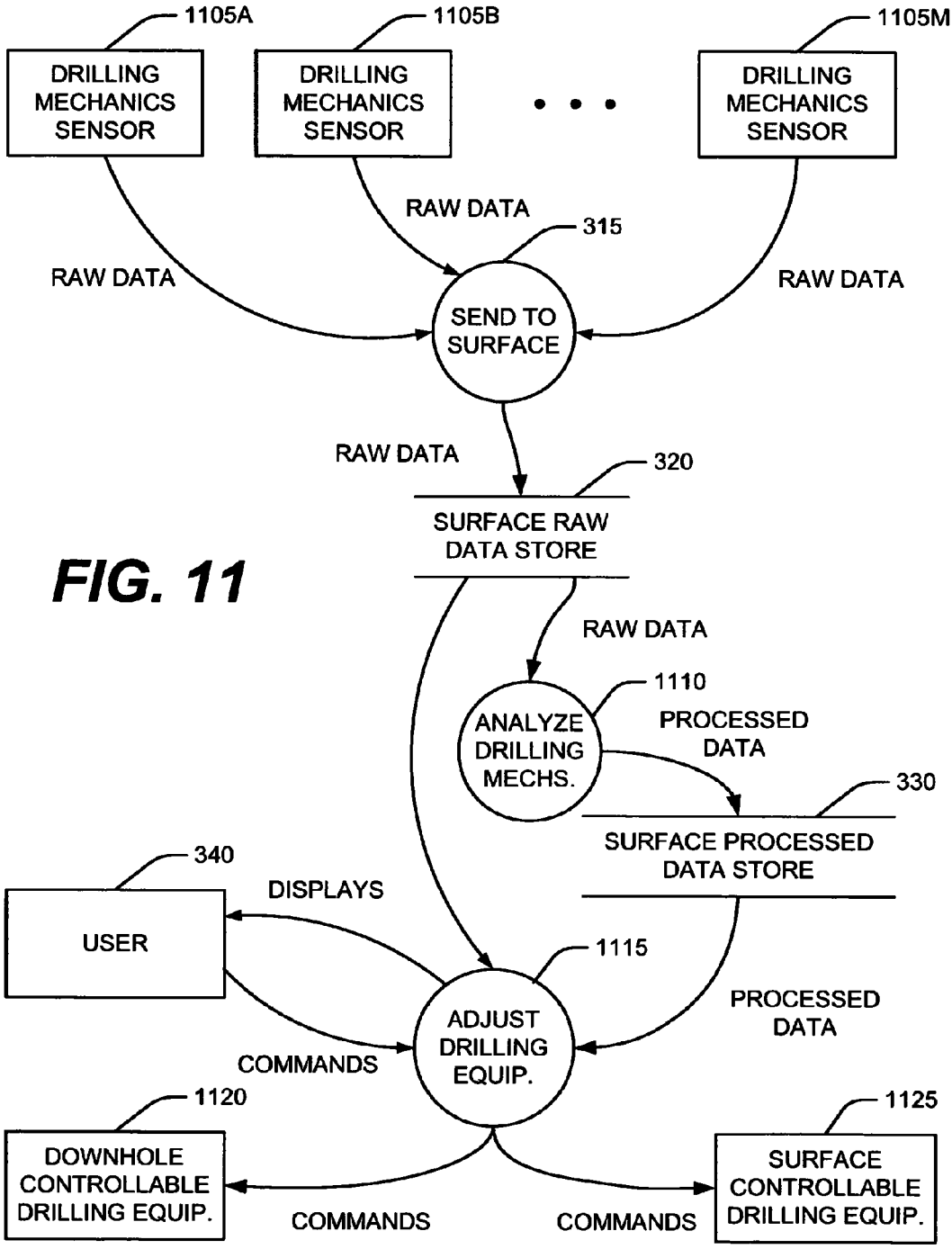

The same apparatus and method can be used with drilling mechanics sensors, as illustrated in FIG. 11. Drilling mechanics sensors 1105A . . . M are located in various locations in the drilling equipment, including in the drilling rig, the drill string and the bottom hole assembly ("BHA"). Raw data is gathered from the drilling mechanics sensors 1105A . . . M and sent to the surface (block 315). The raw data is stored in the surface raw data store (block 320). The raw data in the surface raw data store is analyzed (block 1110) to produce processed data, which is stored in a surface processed data store (block 330). The data in the surface processed data store (block 330) is further processed to determine adjustments that should be made to the drilling equipment (block 1115). The process to adjust the drilling equipment (block 1115) provides displays to a user 340 who can then provide commands to the process for adjusting drilling equipment (block 1115). The process to adjust drilling equipment (block 1115) provides commands that are used to adjust downhole controllable drilling equipment 1120 and surface controllable drilling equipment 1125.

The drilling mechanics sensors may be accelerometers, strain gauges, pressure transducers, and magnetometers and they may be located at various locations along the drill string. Providing the data from these downhole drilling mechanics sensors to the surface real-time processor 185 allows drilling dynamics at any desired point along the drill string to be monitored and controlled in real time. This continuous monitoring allows drilling parameters to be adjusted to optimize the drilling process and/or to reduce wear on downhole equipment.

The downhole drilling mechanics sensors may also include one or more standoff transducers, which are typically high frequency (250 KHz to one MHz) acoustic pingers. Typically, the standoff transducers both transmit and receive an acoustic signal. The time interval from the transmission to the reception of the acoustic signal is indicative of standoff. Interpretation of data from the standoff transducers can be ambiguous due to borehole irregularities, interference from cuttings, and a phenomenon known as "cycle skipping," in which destructive interference prevents a return from an acoustic emission from being detected. Emissions from subsequent cycles are detected instead, resulting in erroneous time of flight measurements, and hence erroneous standoff measurements. Transmitting the data from the downhole drilling mechanics sensors to the surface allows a more complete analysis of the data to reduce the effect of cycle skipping and other anomalies of such processing.

The downhole drilling mechanics sensors may also include borehole imaging devices, which may be acoustic, electromagnetic (resistive and/or dielectric) or which may image with neutrons or gamma rays. An improved interpretation of this data is made in conjunction with drill string dynamics sensors and borehole standoff sensors. Using such data, the images can be sharpened by compensating for standoff, mud density, and other drilling parameters detected by the downhole drilling mechanics sensors and other sensors. The resulting sharpened data can be used to make improved estimates of formation depth.

Thus, borehole images and the data from standoff sensors are not only useful in their own right in formation evaluation, they may also be useful in processing the data from other drilling mechanics sensors.

Figure 12:
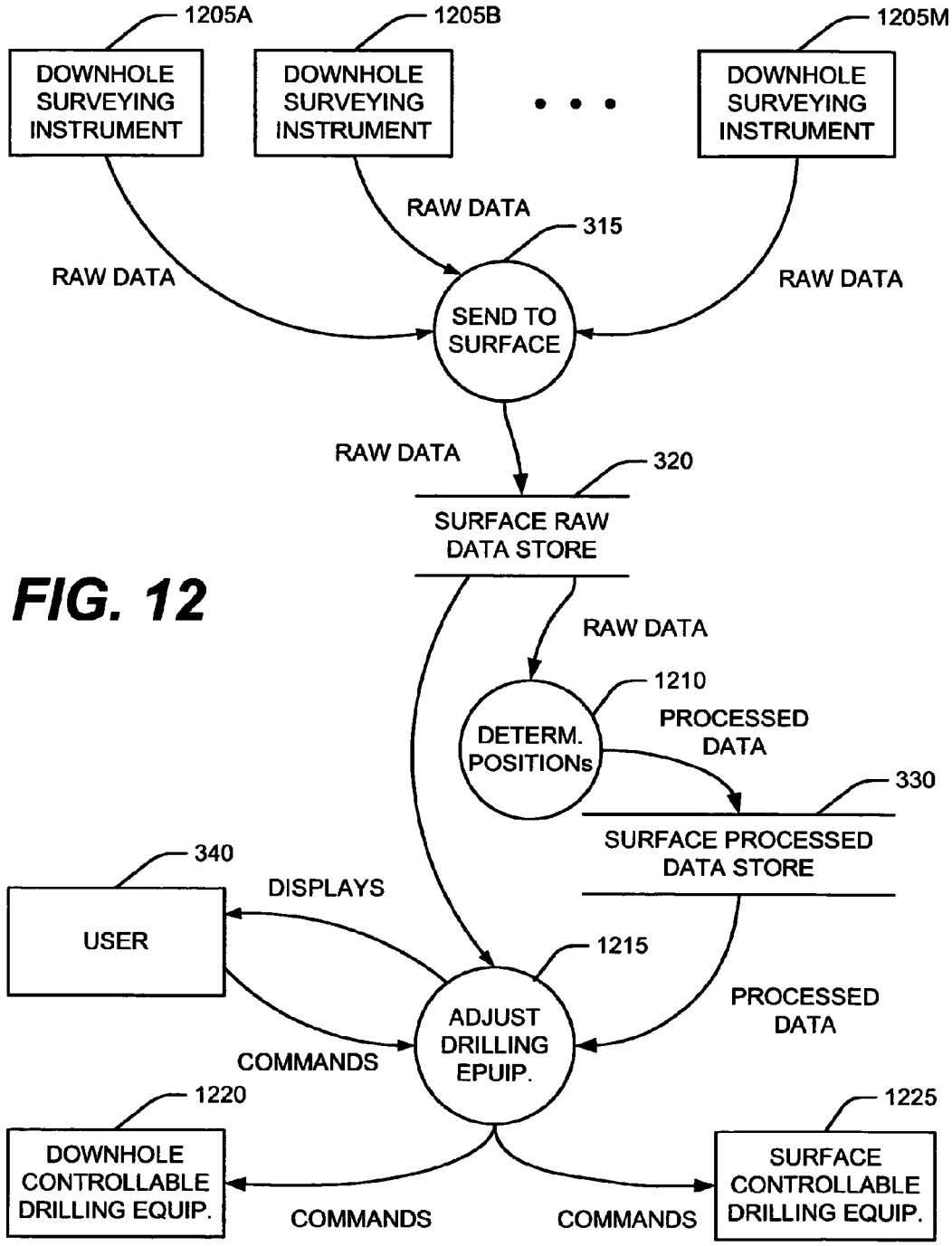

The same apparatus and method can be used with downhole surveying instruments, as illustrated in FIG. 12. Raw data from downhole surveying instruments 1205A . . . M is sent to the surface (block 315) and stored in a surface raw data store (block 320). The raw data is then used to determine the locations of the various downhole surveying instruments 1205A . . . M (block 1210). The processed data is stored in surface processed data store (block 330). That data is used by a process to adjust drilling equipment (block 1215), with the adjustments potentially affecting the drilling trajectory. The process to adjust drilling equipment may produce displays which are provided to a user 340. The user 340 can enter commands which are accepted by the process for adjusting drilling equipment and used in its processing. The process for adjusting drilling equipment (block 1215) produces commands that are used to adjust downhole controllable drilling equipment 1220 and surface controllable drilling equipment 1225.

The use of such downhole surveying instruments and real time surface data processing improves the precision with which downhole positions can be measured. The positional accuracy achievable with even a perfect survey tool (i.e., one that produces errorless measurements) is a function of the spatial frequency at which surveys are taken. Even with a perfect survey tool, the resulting surveys will contain errors unless the surveys are taken continuously and interpreted continuously. A practical compromise to continuous surveying is suggested by the realization that the spatial frequency of surveys taken more frequently than about once per centimeter has little impact on survey accuracy. The high-speed communications media 190 and the surface real-time processor 185 provides very high data rate telemetry and allows surveys to be taken and interpreted at this rate. Further, other types of survey instruments can be used when very high data rate telemetry is available. In particular, several types of gyroscopes, as discussed above with respect to FIGS. 4 and 5, could be used downhole.

Figure 13:
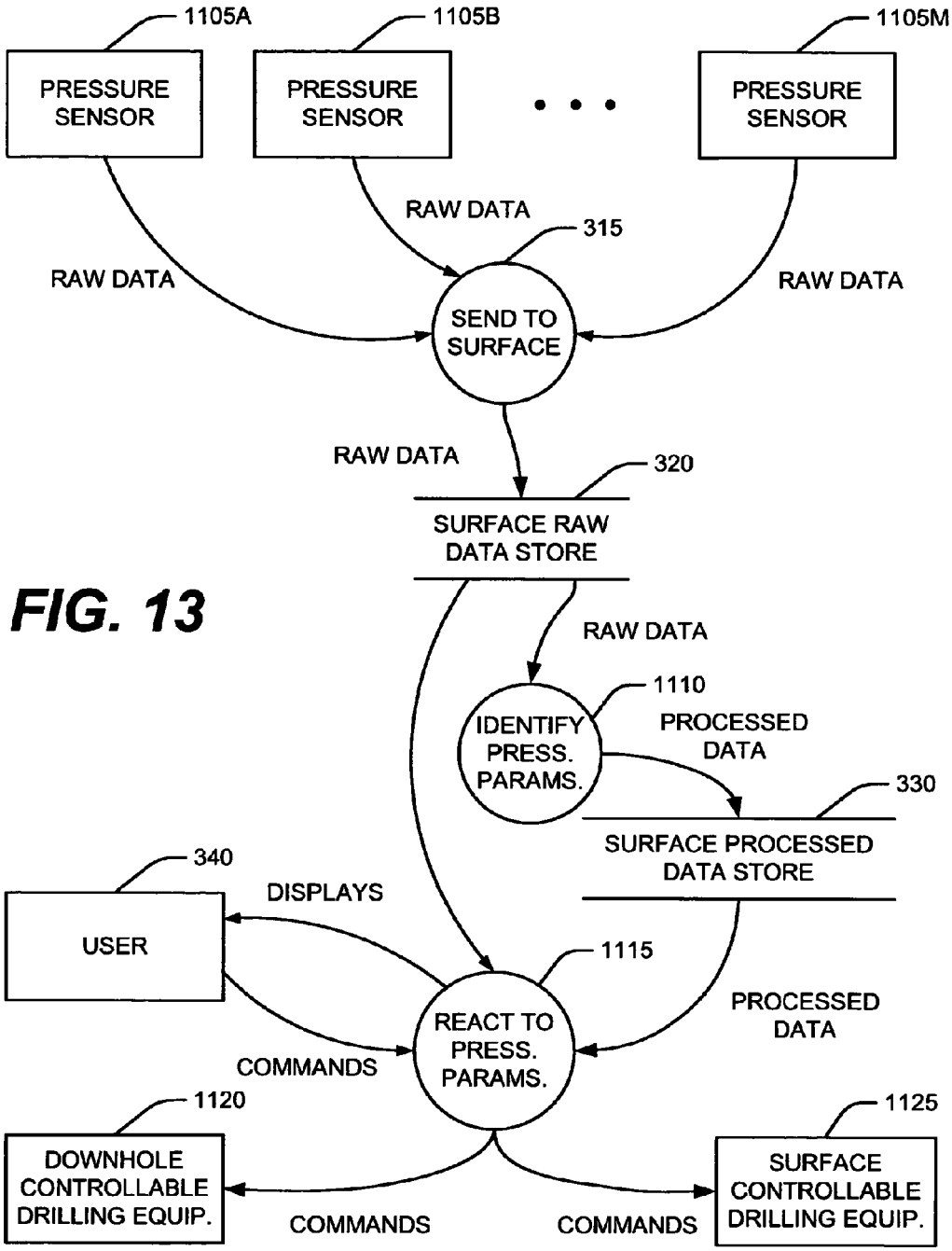

The same apparatus and method can be applied in real-time pressure measurements, as illustrated in FIG. 13. Raw data from pressure sensors 1305A . . . M is sent to the surface (block 315) where it is stored in the surface raw data store (block 320). The raw data is processed to identify pressure characteristics at, for example, a particular point along the drill string or in the borehole or to characterize the pressure distribution all along the drill string and throughout the borehole (block 310). Processed data regarding these pressure parameters is stored in the surface processed data store (block 330). The data stored in the surface processed data store (block 330) is processed in order to react to the pressure parameters (block 1315). Displays are provided to a user 340 who can then issue commands to effect how the system is going to respond to the pressure parameters. The process for reacting to pressure parameters (block 1315) produces commands for downhole controllable drilling equipment 1320 and surface controllable drilling equipment 1325.

This virtually instantaneous transfer of real-time pressure measurements, possibly from numerous locations along the drill string, makes it possible to make a number of real-time measurements of borehole and drilling equipment characteristics, such as leakoff tests, real-time determination of circulating density, and other parameters determined from pressure measurements.

Figure 14:
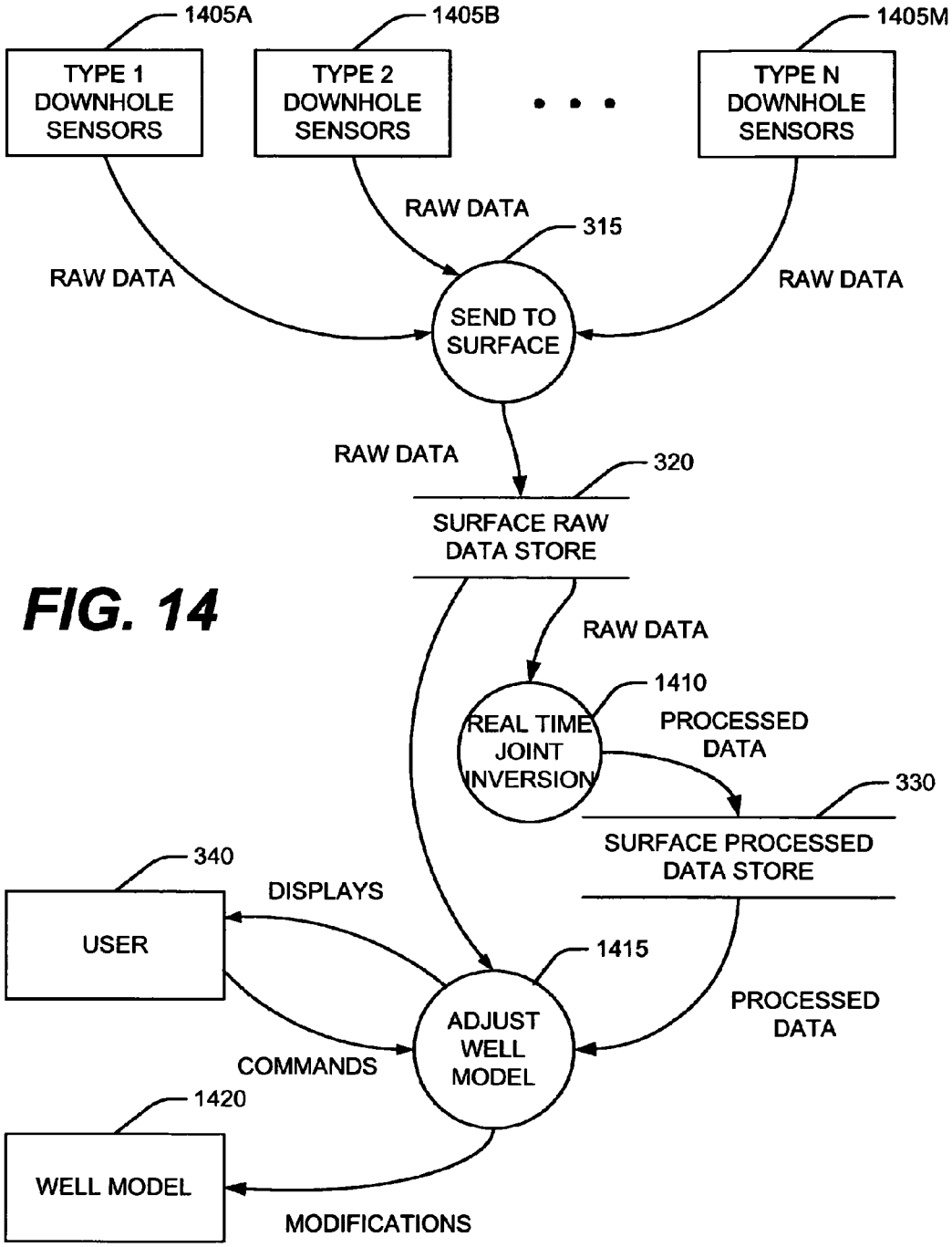

The same apparatus and method can be used to provide real-time joint inversion of data from multiple sensors, as illustrated in FIG. 14. Raw data from various types of downhole sensors 1405A . . . M, which can include any of the above-described sensors or other sensors that are used in oil well drilling and logging, is gathered and sent to the surface (block 315) where it is stored in a surface raw data store (block 320). The raw data from the surface raw data store (block 320) is processed to jointly invert the data as described below (block 1410). Note that joint inversion is just one example of the type of processing that could be performed on the data. Other analytical, computational or signal processing may be applied to the data as well. The resulting processed data is stored in the surface processed data store (block 330). That data is further processed to adjust a well model (block 1415). The process to adjust the well model provides displays to a user 340 and receives commands from the user 340 that affect how the well model is adjusted. The process for adjusting the well model (block 1415) produces modifications which are applied to well model 1420. The well model 1420 may be used in planning drilling and subsequent operations, and may be used in adjusting the plan for the drilling and subsequent operations currently underway or imminent.

If the variables $v_1, v_2, \ldots, v_N$ are related by N functions $f_1, f_2, \ldots, f_N$ of the N variables $x_1, x_2, \ldots, x_N$ by the relation $$\begin{pmatrix} v_1 \\ v_2 \\ \cdots \\ \cdots \\ v_N \end{pmatrix} = \begin{pmatrix} f_1(x_1, x_2, \ldots, x_N) \\ f_2(x_1, x_2, \ldots, x_N) \\ \cdots \\ \cdots \\ f_N(x_1, x_2, \ldots, x_N) \end{pmatrix}$$

Then the process of determining specific values of $x_1, x_2, \ldots, x_N$ from given values of $v_1, v_2, \ldots, v_N$ and the known functions, $f_1, f_2, \ldots, f_N$ is called joint inversion. The process of finding specific functions $g_1, g_2, \ldots g_N$ (if they exist) such that $$\begin{pmatrix} x_1 \\ x_2 \\ \cdots \\ \cdots \\ x_N \end{pmatrix} = \begin{pmatrix} g_1(v_1, v_2, \ldots, v_N) \\ g_2(v_1, v_2, \ldots, v_N) \\ \cdots \\ \cdots \\ g_N(v_1, v_2, \ldots, v_N) \end{pmatrix}$$

$$\text{so that } (v_1, v_2, \ldots, v_N) = g_k(f_k(v_1, v_2, \ldots, v_N)) \text{ for } 1 \le k \le N$$

is also called joint inversion. This process is sometimes carried out algebraically, sometimes numerically, and sometimes using Jacobian transformations, and more generally with any combination of these techniques.

More general types of inversions are indeed possible, where $$\begin{pmatrix} v_1 \\ v_2 \\ \cdots \\ \cdots \\ v_N \end{pmatrix} = \begin{pmatrix} f_1(x_1, x_2, \ldots, x_M) \\ f_2(x_1, x_2, \ldots, x_M) \\ \cdots \\ \cdots \\ f_N(x_1, x_2, \ldots, x_M) \end{pmatrix} \text{ where } M > N$$

but in this case, there is no unique set of functions $g_1, g_2, \ldots, g_M$.

Such joint inversions of data collected from different types of sensors provides an ability to perform comprehensive analysis of formation parameters. Traditionally, a separate interpretation is made of data from each sensor in an MWD or LWD drill string. While this is useful, for a full suite of measurements and for a full suite of sensors, it is difficult to make measurements with adequate frequency to support a comprehensive analysis of formation properties. With the system illustrated in FIG. 14, measurements are available in real time, and information can be combined to provide interpretations such as:

1. Resistivity as a function of depth into a formation (through frequency sweeping, measurements at multiple axial and/or azimuthal spacings, or pulsing);

2. Thickness of formation beds (through joint deconvolution of different types of logs);

3. Mineral composition of formations (e.g. cross-plot several measurements).

Further, since the sensor modules 400 and the controllable element modules 500 may include local azimuthal and/or positional reporting mechanisms (i.e., azimuthal sensors 425 and 530 and gyroscopes 430 and 535), it is possible to build directionally biased detection into the formation evaluation and mechanical sensors described above (either via individually interrogated sensor modules in a circular or spiral array and/or via a single sensor module being rotated with the drill pipe), and including an absolute or relative directional sensor (such as the azimuthal sensors 425 and 530 or the gyroscopes 430 and 535) set with or indexed to the formation evaluation and mechanical sensors. Thereby, all formation evaluation and mechanical data is accompanied by real-time azimuthal information. At a sensing frequency of, for example, 120 hertz, and with the rotary turning at 120 RPM, this would provide an azimuthal resolution of 6 degrees. Using a gyroscope, the sensor placement in the well bore will be highly resolvable notwithstanding drill string precession (whirl) and bit bounce behaviors, which should be well below 100 Hz.

Further, with arrays of certain types of sensors (e.g. electromagnetic or acoustic), it is possible to synthetically steer the direction of greatest sensitivity of the array, making it possible to decouple the rate of acquisition of azimuthal measurements from the rate of rotation of the sensor package. Such measurements require rapid and near simultaneous sampling from all sensors that form the array.

Real time and moment-by-moment azimuthal and/or position indexing available with each sensor module and each controllable element module at various locations in the drill string and bottom hole assembly make possible enhanced formation and drilling process interpretations and model corrections, as well as real-time control actions. Such real-time control actions here and in a general sense as a result of this or other embodiments of the invention may be carried out directly via control signals sent from the processor to a sensor or other controllable element. But in other embodiments the data available at the surface processor, or an associated interpretation, visualization, approximation, or threshold/setpoint alert or alarm, may be provided to a human user at the terminal (either on location or not), with the user then making such a real-time control decision and instructing, either through a control signal, or through manual actions (his own or those of others), to change a particular sensor or controlled element.

The various arrangements of sensor modules and controllable element modules described above can be used in making measurements while tripping. The high speed communications media 190 allows the measurement while tripping to proceed with no practical limitation on the rate of tripping other than sensor physics. The same arrangements can be used during the well completion process (e.g., cementing) by using "throw-away" sensors and controllable elements connected to surface real-time processing with a high-speed communications media.

The present invention is therefore well-adapted to carry out the objects and attain the ends mentioned, as well as those that are inherent therein. While the invention has been depicted, described and is defined by references to examples of the invention, such a reference does not imply a limitation on the invention, and no such limitation is to be inferred. The invention is capable of considerable modification, alteration and equivalents in form and function, as will occur to those ordinarily skilled in the art having the benefit of this disclosure. The depicted and described examples are not exhaustive of the invention. Consequently, the invention is intended to be limited only by the spirit and scope of the appended claims, giving full cognizance to equivalents in all respects.

What is claimed is:

1. A system for data acquisition and control with wired drill pipe providing a high speed communication media including:

one or more sensor modules configured to produce a sensor signal indicative of at least one characteristic of at least one of, the formation being drilled and the drilling process, each of the one or more sensor modules having an operation and an interface to the communication media operable using a communications protocol; a microcontroller associated with each sensor module to control at least one of the interface of that sensor module to the communication media and the operation of that sensor;

an ADC associated with at least one of the sensor modules to convert that sensor module's sensor signal from an analog signal to a digital signal; and a surface processor configured to process the digital signal from one or more of the sensor modules and to issue commands to the one or more sensor modules.

2. The system of claim 1 where:

the communications protocol is selected from one of the following: Manchester, Discrete Multitone, and VDSL CDMA.

3. The system of claim 1 where:

the communications protocol is operable at a rate of at least 1000 bits per second.

4. The system of claim 1 where:

the surface processor processes the data in real time.

5. The system of claim 1, where the wired drill pipe includes a drill string and where:

the one or more sensor modules are distributed along the drill string.

6. The system of claim 1 where the surface processor is further operable to process the received sensor signals to determine the characteristic and to identify changes to be made in the operation of the one or more sensor modules to adjust the measuring of the characteristic.

7. The system of claim 1, further comprising:

a high speed communications medium that includes a separate communications channel for each of the one or more sensor modules.

8. The system of claim 7, where:

the high speed communications medium includes:

one or more busses, each bus being connected to one or more sensors and controllable elements; and an arbitration element for each bus to arbitrate control of that bus among the sensor modules connected to that bus.

9. The system of claim 1 further comprising:

a plurality of controllable element modules, which, when distributed along a portion of a drill string, are configured to excite the formation in the vicinity of the drill string to exhibit the characteristic, each controllable element module being responsive to a control signal.

10. The system of claim 9 where at least one of the controllable element modules is located downhole and at least one of the controllable elements modules is located at the surface, and where the one or more controllable elements comprises:

one or more of an actuator or transmitter device; and an interface to the communications media.

11. The system of claim 9 where the surface processor is further operable to control each of the one or more controllable elements modules, and generate one or more signals to transmit to the one or more sensor modules to reflect the changes to be made in the operation of the sensor modules.

12. The system of claim 1, further comprising:

a program stored on a computer-readable media, the program including executable instructions that cause the surface processor to:

determine the at least one characteristic based, at least in part, on the digital signals from the one or more sensor modules.

13. The system of claim 12, where the executable instructions for determining the at least one characteristic further include executable instructions that cause the surface processor to:

perform a joint inversion of at least a portion of the data from the one or more sensor modules.

14. The system of claim 12, where the executable instructions that cause the surface processor to adjust the measurement of the at least one characteristic of at least one of the formation being drilled and the drilling processing, further cause the surface processor to:

adjust the measurement of the at least one characteristic of at least one of the formation being drilled and the drilling processing based, at least in part, on a parameter regarding the communication of data from one or more sensor modules.

15. The system of claim 12, where the executable instructions further cause the surface processor to:

adjust the measurement of the at least one characteristic of at least one of the formation being drilled and the drilling processing, the adjusting comprising:

transmitting one or more signals to the one or more sensor modules to effect the changes to be made in the operation of the one or more sensor modules.

16. The system of claim 15, where the executable instructions that cause the surface processor to adjust the measurement of the at least one characteristic of at least one of the formation being drilled and the drilling processing, further cause the surface processor to:

adjust the measurement of the at least one characteristic of at least one of the formation being drilled and the drilling processing based, at least in part, on a drilling parameter from an energy source sensor.

17. The system of claim 16, where the drilling parameter from an energy source sensor relates to a characteristic of one or more of source power, frequency, voltage, and current.

18. The system of claim 15, where the executable instructions that cause the surface processor to adjust the measurement of the at least one characteristic of at least one of the formation being drilled and the drilling processing, further cause the surface processor to:

adjust the measurement of the at least one characteristic of at least one of the formation being drilled and the drilling processing based, at least in part, on a sensor acquisition attribute.

19. The system of claim 18, where the a sensor acquisition attribute relates to one of filter setting, dynamic range, amplification, attenuation, resolution, time window or data point count for acquisition, data rate for acquisition, averaging, or synchronicity of data acquisition with a related parameter.

20. The system of claim 12, where the processor determines the at least one characteristic in real time.

21. A method for data acquisition and control with wired drill pipe providing a high speed communication media comprising:

providing one or more sensor modules configured to provide data indicative of at least one characteristic of the formation being drilled or the drilling process;

providing a surface processor;

said sensor module communicating, at high speed, data related to the at least one characteristic of said formation or drilling process to said surface processor;

receiving said data at said surface processor;

performing a control action responsive to said data received to affect one of said drilling process or said data acquisition; and adjusting the measurement of the at least one characteristic of said formation or said drilling process, the adjusting comprising:

transmitting one or more signals to the one or more sensor modules to change the operation of the one or more sensor modules.

22. The method of claim 21, where performing a control action further comprises:

adjusting the measurement of the at least one characteristic of said formation being drilled or said drilling processing based, at least in part, on a parameter regarding the communication of data from one or more sensor modules.

23. The method of claim 21 where:

processing the received data at the surface processor.

24. The method of claim 23, where:

processing the received data includes performing a joint inversion of data from multiple sensors.

25. The method of claim 21, where performing a control action further comprises:

adjusting the measurement of the at least one characteristic of said formation being drilled or said drilling processing based, at least in part, on a s drilling parameter from an energy source sensor.

26. The method of claim 25, where the drilling parameter from an energy source sensor relates to a characteristic of one or more of source power, frequency, voltage, and current.

27. The method of claim 21, where performing a control action further comprises:

adjusting the measurement of the at least one characteristic of said formation being drilled or said drilling processing based, at least in part, on a sensor acquisition attribute.

28. The method of claim 27, where the a sensor acquisition attribute relates to one of filter setting, dynamic range, amplification, attenuation, resolution, time window or data point count for acquisition, data rate for acquisition, averaging, or synchronicity of data acquisition with a related parameter.

* * * * *